US006478414B2

(12) United States Patent
Jeanmaire

(10) Patent No.: US 6,478,414 B2
(45) Date of Patent: Nov. 12, 2002

(54) DROP-MASKING CONTINUOUS INKJET PRINTING METHOD AND APPARATUS

(75) Inventor: David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/750,965

(22) Filed: Dec. 28, 2000

(65) Prior Publication Data

US 2002/0085068 A1 Jul. 4, 2002

(51) Int. Cl.[7] ..... B41J 2/07
(52) U.S. Cl. ..... 347/77; 347/75; 347/82
(58) Field of Search ..... 347/82, 77, 73, 347/75, 15, 21; 209/638, 639

(56) References Cited

U.S. PATENT DOCUMENTS

| | | | | |
|---|---|---|---|---|
| 1,941,001 A | | 12/1933 | Hansell | |
| 3,878,519 A | * | 4/1975 | Eaton | 347/75 |
| 4,317,124 A | | 2/1982 | Shirato et al. | |
| 4,341,310 A | | 7/1982 | Sangiovanni et al. | 209/638 |
| 4,468,679 A | * | 8/1984 | Suga et al. | 347/10 |
| 6,079,821 A | | 6/2000 | Chwalek et al. | |

FOREIGN PATENT DOCUMENTS

| | | | | |
|---|---|---|---|---|
| JP | 1-242259 A | * | 9/1989 | 347/15 |

OTHER PUBLICATIONS

NN7507610, IBM Technical Disclosure Bulletin, "Ink Jet Printer Using Drop Collision Modulation"; Jul. 1, 1975; pp. 610–611.*

* cited by examiner

*Primary Examiner*—Anh T. N. Vo
(74) *Attorney, Agent, or Firm*—Walter S. Stevens

(57) ABSTRACT

Method and apparatus (10, 102) for continuous inkjet printing wherein a first continuous stream of ink droplets (66) traveling above a first flow path (48) is used as a mask for colliding with a second continuous stream of ink droplets (70, 72) traveling along an second, intersecting flow path (56) en route to a receiver (12) on which an image is to be printed. Selective droplets (72) of the second droplet stream are timed and of a size to pass between and avoid the masking droplets (66) of the first droplet stream so as to travel on and impinge the receiver (12) for forming the image thereon. The colliding masking and masked droplets (66, 70) are larger than the selected printing droplets (72) to facilitate collision. The smaller printing droplets (72) facilitate sharp pixel formation. The apparatus is compatible with low voltage CMOS print head systems and provides reliable operation, yet is relatively inexpensive to manufacture compared to other continuous ink jet print head constructions.

24 Claims, 4 Drawing Sheets

DROP-MASKING CONTINUOUS INKJET PRINTING METHOD AND APPARATUS

BACKGROUND OF THE INVENTION

This invention generally relates to a method and apparatus for continuous inkjet printing, and more particularly to a continuous inkjet printing method wherein a first stream of ink droplets traveling along a first flow path is used as a mask by colliding with a second stream of ink droplets traveling along a second, intersecting flow path in route to a receiver on which an image is to be printed, selected droplets of the second droplet stream being timed to pass between and avoid the masking droplets so as to travel on and impinge the receiver for forming the image thereon.

An inkjet printer produces images on a receiver by ejecting ink droplets onto the receiver in an image-wise fashion. The advantages of non-impact, low-noise, low energy use, and low cost operation in addition to the capability of the printer to print on plain paper are largely responsible for the wide acceptance of inkjet printers in the marketplace.

Inkjet printing mechanisms can be categorized as either Drop-on-Demand or continuous inkjet. Continuous inkjet printing dates back to at least 1929. See U.S. Pat. No. 1,941,001 to Hansell.

The term "Drop-on-Demand" characterizes inkjet printers, wherein at every orifice a pressurization actuator is used to produce the inkjet droplet. In this regard, either one of two types of actuators may be used. These two types of actuators are heat actuators and piezoelectric actuators. With respect to heat actuators, a heater placed at a convenient location heats the ink and a quantity of the ink will phase change into a gaseous steam bubble and raise the internal ink pressure sufficiently for an ink droplet to be expelled to the recording medium. A feature of the heat-type actuators is the ability to incorporate them easily into modern known print head constructions, particularly those using silicon substrates with CMOS electrical circuitry. One disadvantage, however, is that the overall electrical power consumption is large, especially in "page-width" arrays. With respect to piezoelectric actuators, a piezoelectric material is used, which piezoelectric material possesses piezoelectric properties such that a mechanical stress is produced when an electric field is applied.

The most common of the "continuous" inkjet printers utilize electrostatic charging tunnels that are placed close to the point where ink droplets are being ejected in the form of a stream. Selected ones of the droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the recording medium. A disadvantage of the known continuous inkjet printers, however, is that the charging apparatus is complex and costly to incorporate into the print head. In addition, the interaction between charged drops can adversely affect image quality.

A novel continuous inkjet printer is described and claimed in U.S. Pat. No. 6,079,821, issued to Chwalek et al. on Jun. 27, 2000, and assigned to the Eastman Kodak Company. Such printers use asymmetric heating in lieu of electrostatic charging tunnels to deflect ink droplets toward desired locations on the recording medium. In this device, a droplet generator formed from a heater having a selectively-actuated section associated with only a portion of the nozzle bore perimeter is provided for each of the ink nozzle bores. Periodic actuation of the heater element via a train of uniform electrical power pulses creates an asymmetric application of heat to the stream of droplets to control the direction of the stream between a print direction and a non-print direction.

While such continuous inkjet printers have demonstrated many proven advantages over conventional inkjet printers using electrostatic charging tunnels, there are still some areas in which such printers can be improved, particularly in the area of the ability to operate reliably on a wide range of different ink fluids, and in lower-temperature operation of heaters.

For example, the use of two fluid jets in droplet formation, has been disclosed by Sangiovanni et al. in U.S. Pat. No. 4,341,310 issued on Jul. 27, 1982, for a method called "masking". In this "masking" method, separate streams of "polar" and "non-polar" monodispersed liquid droplets are coordinated to intersect at an intersection point to "mask" or prevent passage of the "nonpolar" liquid droplets. This technique, however, does not involve colliding jet streams of ink in an image-wise manner for printing purposes. But rather, it requires a complex charging apparatus for altering the path of the "polar" droplets. This is costly and requires a relatively high voltage, not easily compatible with known low voltage CMOS print head systems, typically operating at from two to six volts.

Therefore, there is a need to provide an inkjet printing method that provides the respective advantages of continuous inkjet printing, and Drop-on-Demand inkjet printing, with low voltage operation and low power consumption. To accomplish this by the use of a inkjet-masking concept, which avoids the complexity and cost disadvantages of the known "masking" methods would be a surprising but welcomed advancement in the art.

SUMMARY OF THE INVENTION

An object of the present invention is to provide a continuous inkjet printing method and apparatus which utilizes desirable aspects of "on-demand" printing and "masking" concepts without including the undesirable aspects of their respective printing apparatus.

With this object in view, the present invention resides in an inkjet printing method comprising the steps of (1) generating a first stream of ink droplets traveling along a first flow path, and (2) generating a second stream of ink droplets traveling along a second flow path which intersects the first flow path at a predetermined location. The second stream of ink droplets includes ink droplets traveling in timed relation to the droplets of the first stream so as to collide with the droplets of the first stream at the predetermined location and be diverted to an ink receptacle. The second stream of ink droplets also includes selected droplets traveling in timed relation to the droplets of the first stream so as to pass between the droplets of the first stream at the predetermined location and continue along the second flow path so as to impinge a receiver at a down stream location along the second flow path for forming an image on the receiver.

According to an exemplary embodiment of the present invention, an inkjet printer is provided comprising an element for emitting a first ink stream along a first flow path; an element located along the first flow path upstream of the predetermined location for controllably breaking the first ink stream into successive ink droplets traveling along the first flow path; an element for emitting a second ink stream along a second flow path which intersects the first flow path at a predetermined location; an element located along the second flow path upstream of the predetermined location for controllably breaking the second ink stream into successive ink droplets traveling along the second flow path; and an element for controlling the time relationship of droplet formation between the ink streams such that selected ink droplets of the first stream will pass between or collide with the ink droplets of the second stream at the predetermined intersection location in an image-wise manner. In the absence of a collision between droplets, the droplets moving along the first path impinge on an image receiver located beyond the predetermined jet-crossing location.

Another feature of the present invention is the provision of an element for controllably generating a stream of ink droplets by intermittently effecting surface tension and viscosity changes in a continuous stream of ink.

Another feature of the present invention is the provision of two streams of ink droplets traveling along intersecting flow paths, wherein one of the streams of ink droplets includes selected droplets timed to pass between the droplets of another of the streams so as to travel on and impinge a receiver for forming an image thereon.

Another feature of the present invention is the provision of an element for controllably breaking a stream of ink into a succession of ink droplets traveling in timed relations to one another along a flow path.

Another feature of the present invention is the provision of streams of ink droplets generated by transiently heating continuous streams of ink to break the streams into the droplets, wherein larger ink droplets are generated by longer time intervals between the heat pulses and smaller ink droplets are generated by shorter intervals between the heat pulses.

An advantage of the present invention is the capability to selectively mask a stream of ink droplets without requiring droplet electrical polarization.

Another advantage of the present invention is the capability to generate different size ink droplets from a single continuous ink stream.

Still another advantage of the present invention is the ability to provide a drop-masking continuous ink jet printing method that is compatible with a low voltage print head system.

These and other objects, features and advantages of the present invention will become apparent to those skilled in the art upon a reading of the following detailed description when taken in conjunction with the drawings which show and describe illustrative embodiments of the invention.

BRIEF DESCRIPTION OF THE DRAWINGS

While the specification concludes with claims particularly pointing out and distinctly claiming the subject matter of the present invention, it is believed that the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
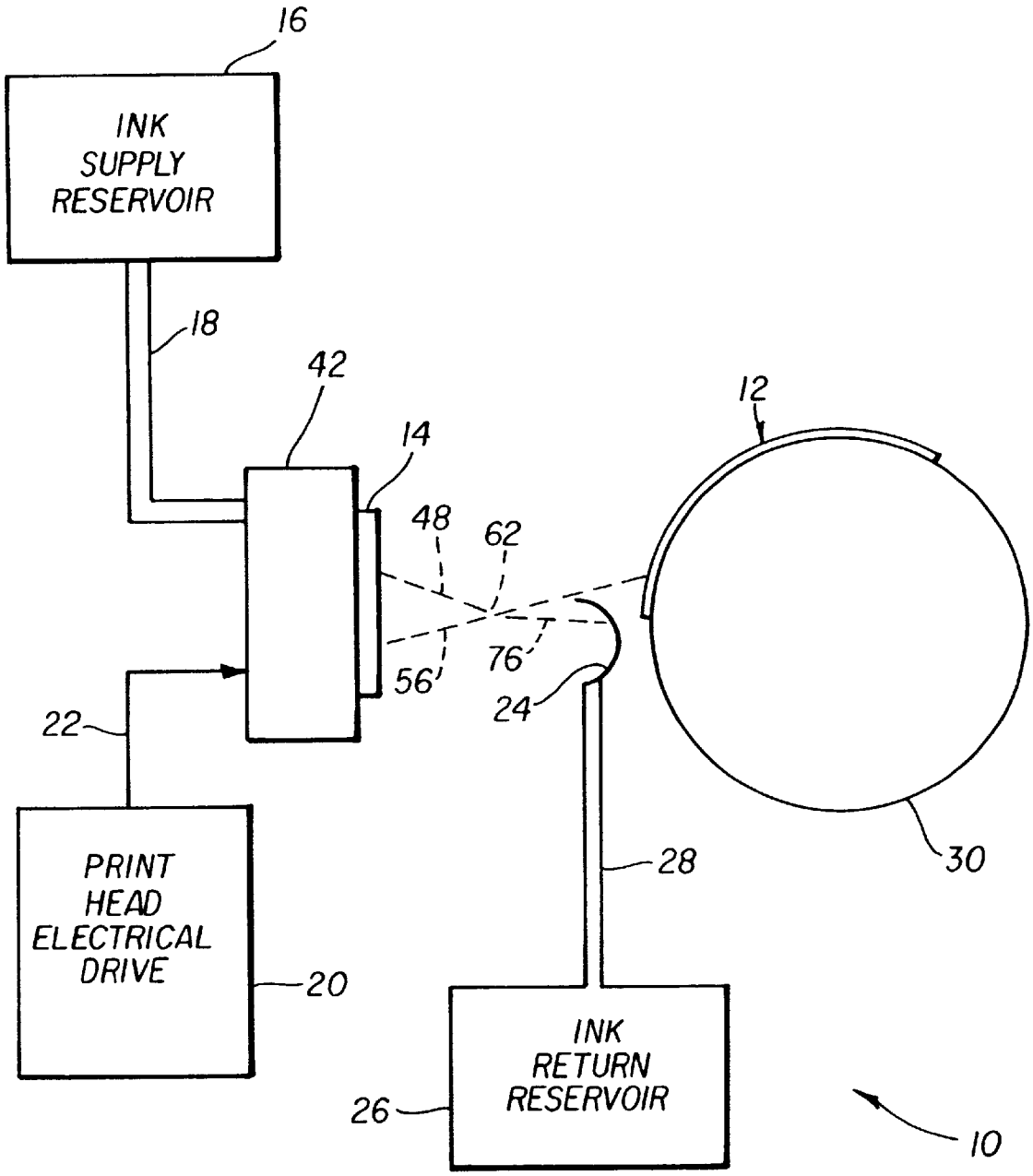
FIG. 1 is a simplified schematic representation illustrating a method and apparatus for drop-masking continuous inkjet printing according to the present invention.

Referring to FIG. 1, there is shown apparatus 10 for drop-masking continuous inkjet printing constructed and operable according to the teachings of the present invention. Apparatus 10 is shown in association with a receiver 12 onto which an image is to be formed by apparatus 10, which receiver 12 can comprise any suitable conventional recording medium, such as a sheet of paper, a transparent film or the like. Apparatus 10 includes a print head 14, an ink supply reservoir 16 connected to print head 14 by an ink supply channel 18 for supplying ink thereto, a print head electrical drive 20 connected to print head 14 by a conductive path 22 for communicating electrical drive signals to print head 14 for controllably operating print head 14, an ink gutter 24 disposed between receiver 12 and print head 14 connected to an ink return reservoir 26 via an ink return conduit 28, and a rotatable drum 30 for holding and moving receiver 12 relative to print head 14 during the printing operation.

Figure 2:
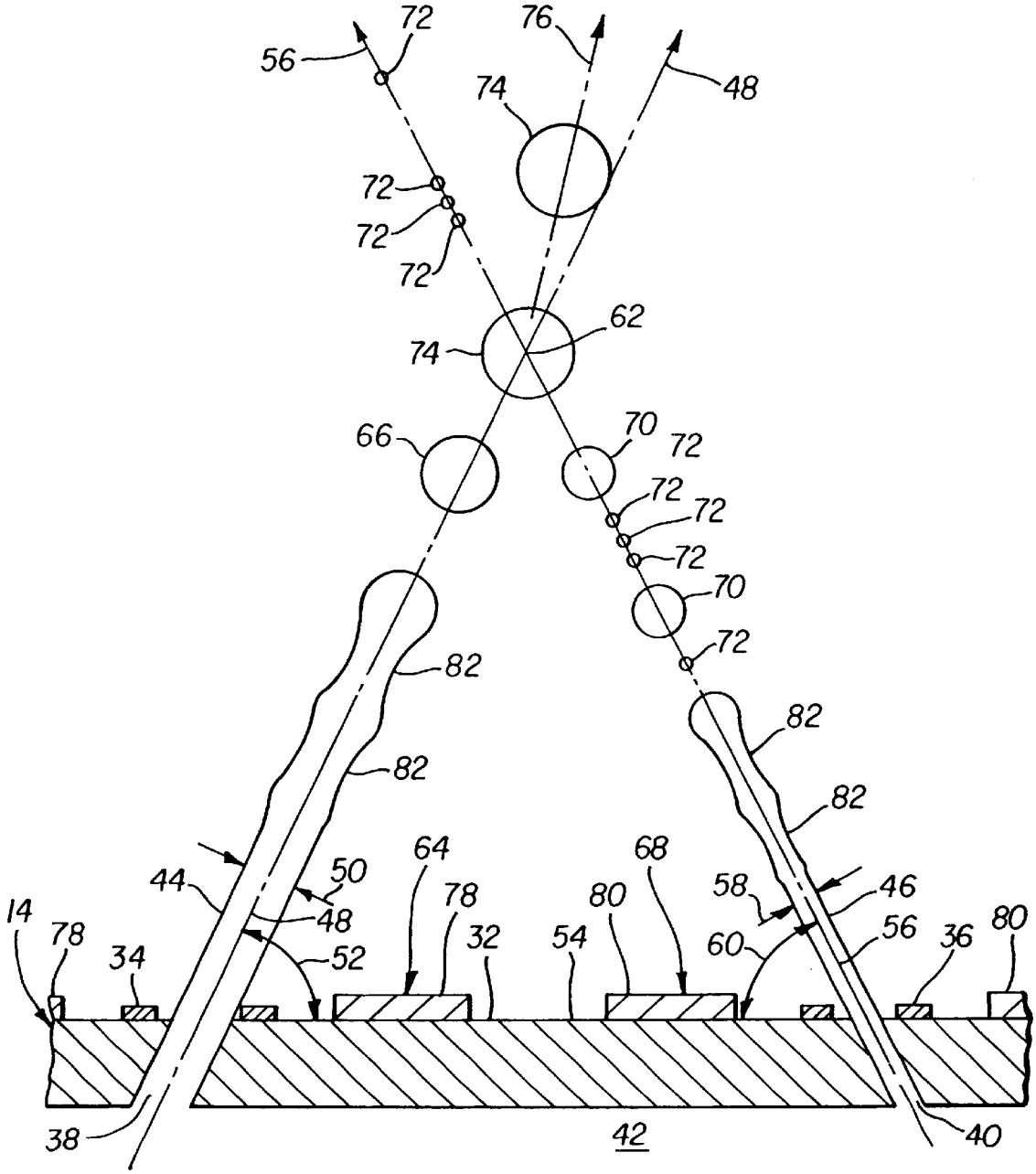
FIG. 2 is a simplified schematic sectional representation of one embodiment of a print head of the invention shown emitting intersecting streams of ink droplets for illustrating a masking aspect of the invention.

Referring also to FIG. 2, print head 14 includes a nozzle plate 32 including a plurality of pairs of ink ejecting nozzles 34 and 36 having orifices 38 and 40, respectively, communicating with at least one ink chamber 42 connected in fluid communication with ink supply reservoir 16 via an ink supply channel 18 in a conventional and well known manner. Ink within ink chamber 42 is emitted from print head 14 through orifices 38 and 40 of ink ejecting nozzles 34 and 36 in continuous ink streams 44 and 46, respectively, under pressure generated using a suitable conventional device such as a pump or the like (not shown). Ink stream 44 is emitted along a flow path 48, and has a cross-sectional extent as denoted at 50 and an angular orientation as denoted at 52 relative to a front surface 54 of nozzle plate 32 which are determined by the size of orifice 38 and angle thereof relative to front surface 54. Similarly, ink stream 46 is emitted from orifice 40 along a flow path 56, and has a cross-sectional extent 58 and an angular orientation 60 relative to front surface 54 which are determined by the cross-sectionals extent of orifice 40 and angular orientation thereof relative to front surface 54. Flow path 48 and flow path 56 are oriented with respect to one another so as to intersect at a predetermined location 62 spaced from front surface 54 of nozzle plate 32. Print head 14 includes an element 64 operable for controllably breaking ink stream 44 into successive ink droplets flowing along flow path 48, represented by ink droplet 66, upstream of predetermined location 62. Similarly, print head 14 includes an element 68 operable for controllably breaking ink stream 46 into ink droplets flowing along flow path 56, represented by ink droplets 70 and 72, upstream of location 62.

As a result of the size and timing of the respective ink droplets 66, 70 and 72, ink droplets 66 traveling along flow path 48 collide with ink droplets 70 traveling along flow path 56 at location 62, to thereby "mask" the affected ink drops 70, that is, prevent their continued passage along flow path 56 past location 62 while permitting ink droplets 72 to proceed along flow path 56. Referring briefly again to FIG. 1, drum 30 is positioned in spaced relation to flow path 56 such that ink droplets 72 that travel pass location 62 can impinge receiver 12. Ink gutter 24 is positioned to receive any ink droplets 66 traveling along flow path 48 which do not collide with ink droplets 70, and also ink droplets 74 which are formed by the collisions of ink droplets 66 and ink droplets 70, the collision causing ink droplets 74 to be directed along a new flow path 76 disposed between flow paths 48 and 56. To facilitate the masking function of ink droplets 70, it has been found to be advantageous for those individual droplets 66 to be larger than droplets 70 and 72 for several reasons. Namely, the larger that ink droplets 66 are, the more momentum they will have to cause combined droplets 74 to travel along new flow path 76 divergent from flow path 56. Also, the larger that ink droplets 66 are, the easier it is to coordinate the collision thereof with ink droplets 70. In droplets 66 larger than ink droplets 70 and 72 can be achieved by using a variety of techniques. Here, orifice 38 of ink ejecting nozzle 34 has a larger cross-sectional extent than the cross-sectional extent of orifice 40 of ink ejecting nozzle 36, such that ink stream 44 has a correspondingly larger cross-sectional extent 50 than the cross-sectional extent 58 of ink stream 46. Additionally, elements 64 and 68 operable for controllably breaking ink streams 44 and 46 into ink droplets 66 and ink droplets 70 and 72, respectively, include annular shaped heaters 78 and 80 disposed on front surface 54 of nozzle plate 32 around respective ink ejecting nozzles 34 and 36, heaters 78 and 80 being selectively operable to heat ink streams 44 and 46 as they pass from nozzles 34 and 36, to reduce the surface tension of the ink which results in sufficient widening of the ink streams, as denoted at regions or zones 82, such that the resulting pressure differences in the stream cause ink droplets to form. Here, it should be noted that ink droplets 66, 70, 72 and 74 are depicted as circles in two dimension so as to represent spheres in three dimension, although in practice, the droplets may have somewhat different shapes. It should also be noted that ink droplets 70 are substantially larger than ink droplets 72, and that ink droplets 70 are intended to be masked, that is collide with ink droplet 66, whereas ink droplet 72 are intended to pass between ink droplets 66 so as to continue along flow path 56 and impinge receiver 12 for forming the image thereon. In this regard, the larger ink droplets facilitate collision, whereas sequences of one to several successive small ink droplets are preferred to form correspondingly small pixels on a receiver such as receiver 12 to produce a sharper image thereon. As noted above, another advantage is that the small ink droplets 72 are able to pass more readily between the successive ink droplet 66.

Figure 3:
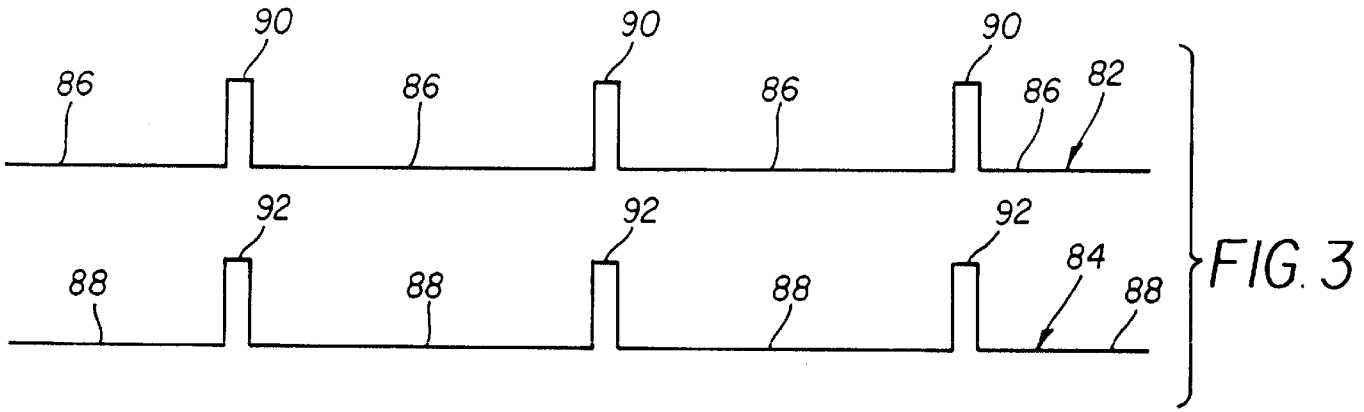
FIG. 3 is a graphical representation of electrical drive signal traces for the apparatus of FIG. 1 in a non-printing mode.

Referring to FIG. 3, an electrical signal trace representing drive signals generated by print head electrical drive 20 communicated to heater 78 for energizing that heater to produce ink droplets 66 versus time is shown, above a signal trace 84 representing electrical signals generated by drive 20 for energizing heater 80. Traces 82 and 84 represent a nonprinting mode, that is, wherein the ink droplets generated from ink stream 46 collide with ink droplets 66 so that no droplets of ink stream 46 pass location 62 intact. In traces 82 and 84, signal intervals 86 and 88 represent time periods wherein heaters 78 and 80 are not energized, such that ink streams 44 and 46 are unaffected by the heaters, whereas elevated signal amplitude intervals 90 and 92 between intervals 86 and 88 represent time periods wherein heaters 78 and 80 are energized, which results in the synchronous breaking of ink streams 44 and 46 into ink droplets. Here, signal intervals 90 and 92 are timed so as to be simultaneous such that ink streams 44 and 46 will be broken into droplets timed to collide with one another thereby providing the desired masking effect.

Figure 3A:
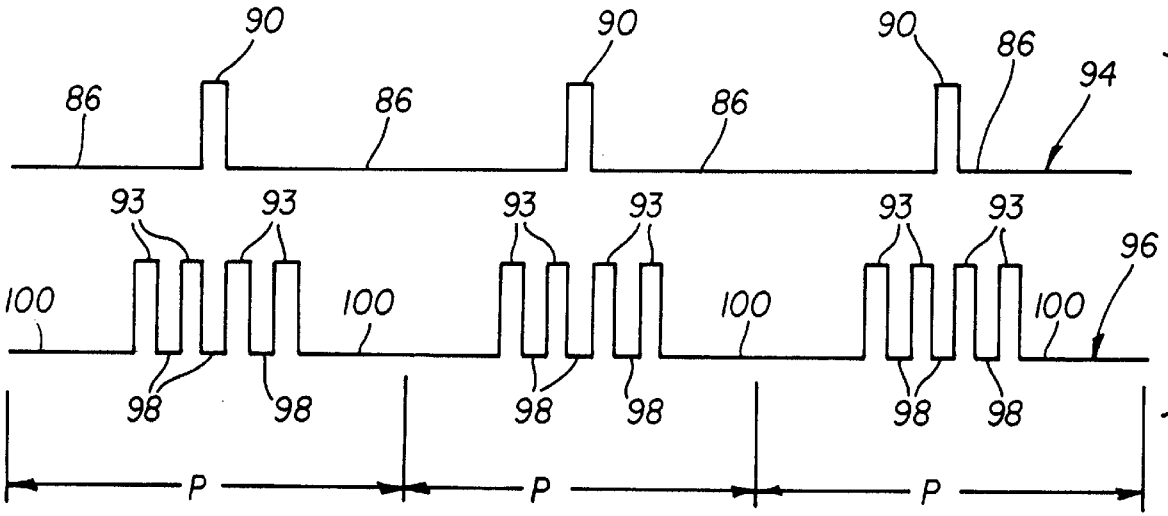
FIG. 3*a* is a graphical representation of electrical drive signal traces for the apparatus of FIG. 1 in a printing mode.

Referring to FIG. 3*a*, electrical signal traces 94 and 96 representing electrical drive signals provided to heaters 78 and 80, respectively, in a printing mode are shown. Trace 94 includes the same signal intervals 86 and 90 as trace 82, corresponding to the regular breaking of ink streams 44 into uniformly spaced and sized ink droplets such as ink droplets 66 of FIG. 2. Trace 96, however, is significantly different from non-printing mode trace 84. In a preferred implementation, which allows for the printing of multiple drops per image pixel, the time P associated with the printing of an image pixel consists of a burst of short-duration elevated-amplitude signal intervals 93 separated by low-amplitude signal intervals 98. The signal intervals 93 are center-weighted in time during the time P as indicated in FIG. 3*a*, and are separated from the next pixel data by lower-amplitude signal intervals 100. The number of elevated-amplitude signal intervals 93 to be used in the activation of heater 80 is the number of drops to be printed per pixel plus one. An example is given here for the printing of 3 drops per pixel, although it must be realized that this is for illustrative purposes only, and that the number of drops to be printed is intended to be varied according to image data. Additionally, this invention is not limited to a particular maximum number of drops per image pixel. Again, the elevated-amplitude signal intervals 93 result in the breaking of ink steam 46 of FIG. 2 into ink droplets. The intervening low signal amplitude intervals 98 are proportional to the volume of ink droplets 72, and the longer low amplitude signal intervals 100 are proportional to the volume of ink droplets 70. The relative timing of higher amplitude signal intervals 90 and 93 of traces 94 and 96 are selected such that ink droplets 66 and 70 will collide at location 62, whereas ink droplets 72 will pass between ink droplets 66 so as to continue along flow path 56 to impinge the receiver. Here, it should be recognized and understood that the size and spacing parameters of the ink droplets broken from ink streams 44 and 46 are controlled by operation of respective heaters 78 and 80, and thus such parameter can be altered as desired to provide desired image characteristics. Additionally, it is contemplated that any desired number of ink droplets can be utilized for forming the pixels of an image. Still further, it should be recognized and understood that elements 64 and 68 can additionally and alternatively include other elements for breaking ink streams 44 and/or 46 into the desired ink droplets, including, but not limited to, other thermoelectric heater constructions, heaters located at different locations, mechanical devices, and electromechanical devices. It should also be understood that ink ejecting nozzles 34 and 36 can include orifices that differ from orifices 38 and 40 (FIG. 2) including orifices oriented so as to be perpendicular to front surface 54 of nozzle plate 32, as long as at least one element is provided for directing the ink streams emitted therefrom along the required intersecting flow paths.

Figure 4:
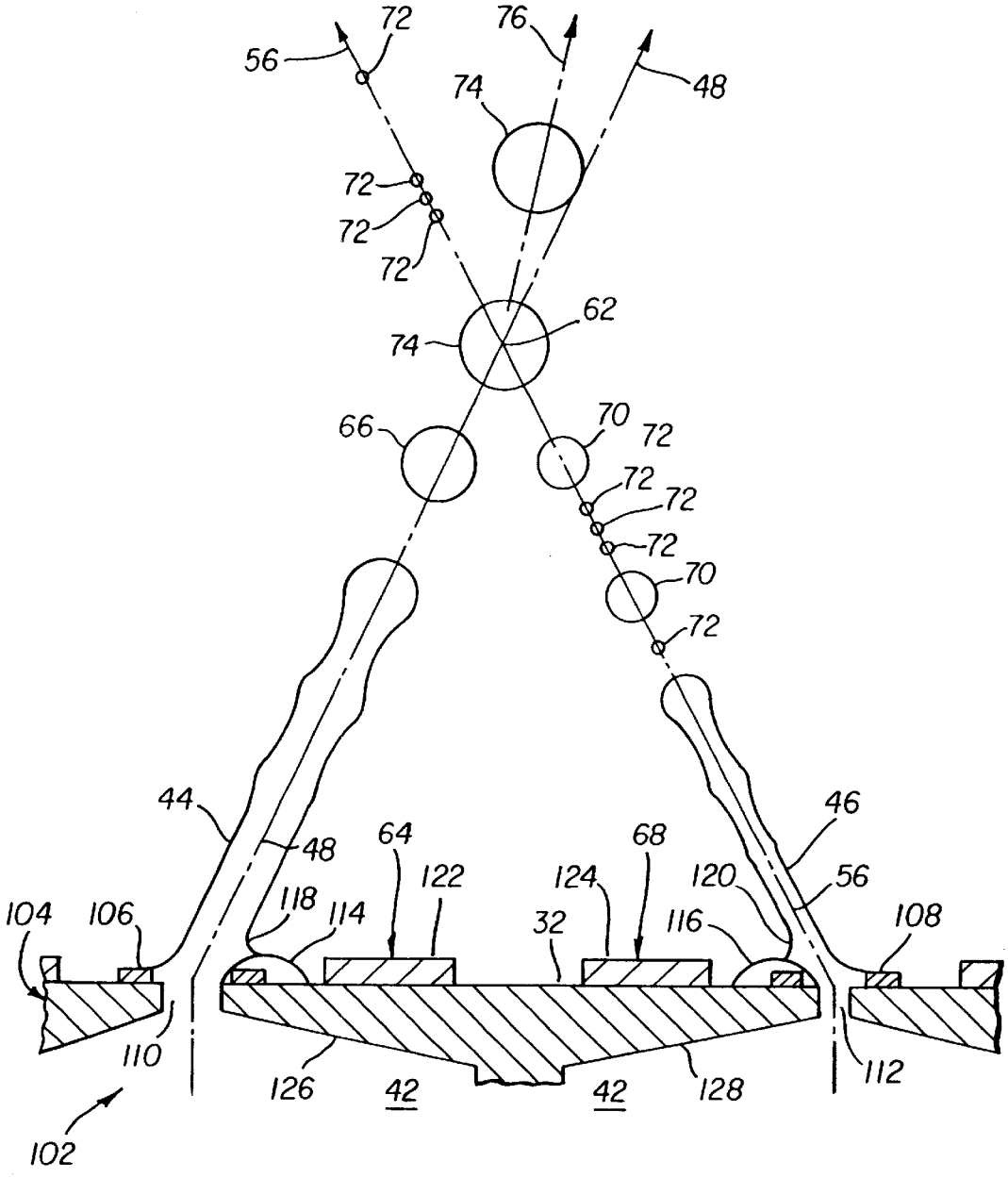
FIG. 4 is a simplified schematic sectional representation of another embodiment of a print head according to the invention shown emitting intersecting streams of ink droplets for illustrating the masking aspect of the invention.

Turning to FIG. 4, alternative apparatus 102 for drop masking continuous ink jet printing constructed and operable according to the teachings of the present invention is shown. Like elements of apparatus 102 and apparatus 10 are identified by like numbers. Apparatus 102 includes a print head 104 including an ink chamber 42 adapted for connection in fluid communication with an ink supply reservoir such as reservoir 16 (FIG. 1), and a nozzle plate 32 including a plurality of pairs of ink ejecting nozzles 106 and 108 having respective orifices 110 and 112 therethrough in communication with ink chamber 42 for emitting ink streams 44 and 46 therefrom. Orifices 110 and 112 differ from previously disclosed and discussed orifices 38 and 40 of apparatus 10 in that orifices 110 and 112 are perpendicular to front surface 32 of print head 104. In order to direct ink streams 44 and 46 emitted from orifices 110 and 112 along flow paths 48 and 56 so as to intersect at predetermined location 62, nozzles 106 and 108 include raised structures 114 and 116 formed of or coated with a suitable conventional hydrophilic material (for use with aqueous inks). Bead structures 114 and 116 function by attracting the ink of the ink streams 44 and 46 so as to effect a change in the meniscus 118 at the juncture of ink stream 44 and nozzle 106, and in the meniscus 120 at the juncture of ink stream 46 and nozzle 108, sufficiently so as to skew or direct flow paths 48 and 56 toward location 62.

Apparatus 102 includes elements 64 and 68 adapted for operative connection to a print head electrical drive such as drive 20 (FIG. 1) for breaking ink streams 44 and 46 into ink droplets such as ink droplets 66, 70 and 72, here including piezoelectric devices 122 and 124 energizable for deforming thinner membrane portions 126 and 128 of nozzle plate 32 sufficiently to cause the desired intermittent breaking of ink streams 44 and 46.

Therefore, what is provided is a continuous inkjet printing method and apparatus which utilizes desirable aspects of on-demand and masking concepts, while eliminating more complex and costly aspects of the above, namely, charging apparatus with associated high voltage circuitry.

The apparatus and methods described herein are preferred as they facilitate simplified, lower cost print head manufacture.

The foregoing describes a number of preferred embodiments of the present invention. Modifications, obvious to those skilled in the art, can be made thereto without departing from the scope of the invention.

PARTS LIST

10 apparatus for drop-masking continuous inkjet printing
12 receiver
14 print head
16 ink supply reservoir
18 ink supply channel
20 print head electrical drive
22 conductive path
24 ink gutter
26 ink return reservoir
28 ink return conduit
30 drum
32 nozzle plate
34 ink ejecting nozzle
36 ink ejecting nozzle
38 orifice
40 orifice
42 ink chamber
44 inkstream
46 ink stream
48 flow path
50 cross-sectional extent
52 angular orientation
54 front surface
56 flow path
58 cross-sectional extent
60 angular orientation
62 location
64 element
66 ink droplet
68 element
70 ink droplet
72 ink droplet
74 ink droplet
76 flow path
78 heater
80 heater
82 trace
84 trace
86 signal interval
88 signal interval
90 signal interval
92 signal interval
93 signal interval
94 trace
96 trace
98 signal interval
100 signal interval
102 apparatus for drop-masking continuous inkjet printing
104 print head
106 ink ejecting nozzle
108 ink ejecting nozzle
110 orifice
112 orifice
114 bead structures
116 bead structures
118 meniscus
120 meniscus
122 piezoelectric device
124 piezoelectric device
126 membrane position
128 membrane position

What is claimed is:

1. An inkjet printing method comprising the steps of:

generating a first stream of ink droplets traveling along a first flow path; and generating a second stream of ink droplets traveling along a second flow path which intersects the first flow path at a predetermined location, the second stream of ink droplets including droplets traveling in timed relation to the droplets of the first stream so as to collide with the droplets of the first stream at the predetermined location and be diverted to an ink receptacle, the second stream of ink droplets also including selected droplets traveling in timed relation to the droplets of the first stream so as to pass between the droplets of the first stream at the predetermined location and continue along the second flow path for impinging a receiver at a downstream location along the second flow path for forming an image on the receiver, wherein the selected droplets comprise successive droplets disposed between other droplets of the second stream larger than the successive droplets.

2. The method of claim 1, wherein the successive droplets impinge the receiver in close proximity to one another for forming pixels on the receiver.

3. The method of claim 1, wherein the ink droplets are formed by heat.

4. The method of claim 1, wherein the ink droplets of the first stream are larger than the selected droplets.

5. The method of claim 1, wherein the streams of ink droplets are each generated by pulsingly heating a continuous stream of ink to break the stream into droplets, the larger of the ink droplets being generated by longer intervals between heat pulses.

6. The method of claim 1, wherein the ink droplets of the first stream are substantially uniformly spaced apart.

7. The method of claim 1, wherein the ink droplets are generated by intermittently effecting surface tension reductions in a continuous stream of ink.

8. A continuous inkjet printing method, comprising the steps of:

providing an element for emitting a first ink stream along a first flow path;

providing an element for emitting a second ink stream along a second flow path which intersects the first flow path at a predetermined location;

providing an element along the first flow path upstream of the predetermined location for controllably breaking the first ink stream into successive ink droplets traveling along the first flow path;

providing an element along the second flow path upstream of the predetermined location for controllably breaking the second ink stream into successive ink droplets traveling along the second flow path; and controlling the breaking of one of the ink streams such that selected of the ink droplets thereof will pass between the ink droplets of another of the ink streams at the predetermined location and impinge a receiver located beyond the predetermined location, wherein said one of the ink streams has a cross-sectional extent which is smaller than a cross-sectional extent of said other ink stream.

9. The method of claim 8, wherein the elements for breaking the ink streams into the ink droplets comprise heaters.

10. The method of claim 8, wherein said one of the ink streams is controllably broken such that the selected ink droplets are smaller than the ink droplets of said other ink stream.

11. The method of claim 8, wherein the ink streams are broken by reducing surface tension thereof at intermittent length intervals therealong.

12. A continuous inkjet printhead comprising:

a first nozzle orifice for emitting a first ink stream along a first flow path, the first nozzle orifice having a cross-sectional extent;

a second nozzle orifice for emitting a second ink stream along a second flow path which intersects the first flow path at a predetermined location, the second nozzle orifice having a cross-sectional extent that is larger than the cross-sectional extent of the first nozzle orifice;

an element located along the first flow path upstream of the predetermined location for controllably breaking the first ink stream into successive ink droplets traveling along the first flow path;

an element located along the second flow path upstream of the predetermined location for controllably breaking the second ink stream into successive ink droplets traveling along the second flow path;

an element for controlling breaking of the first ink stream such that at least selected ink droplets of the first ink stream will pass between the ink droplets of the second ink stream at the predetermined location for impinging a receiver located beyond the predetermined location.

13. The continuous inkjet printhead of claim 12, wherein the elements for controllably breaking the ink streams into successive ink droplets comprise heaters.

14. The continuous inkjet printhead of claim 12, the printhead including a nozzle plate having a front surface, wherein the second nozzle orifice is positioned at an angle relative to the front surface of the nozzle plate.

15. The continuous inkjet printhead of claim 12, wherein the first ink stream includes other ink droplets timed to collide with ink droplets of the second ink stream so as to not impinge the receiver.

16. The continuous inkjet printhead of claim 15, further comprising a receptacle adapted and positioned for receiving the colliding ink droplets.

17. The continuous inkjet printhead of claim 12, the printhead including a nozzle plate having a front surface, wherein the first nozzle orifice is positioned at an angle relative to the front surface of the nozzle plate.

18. The continuous inkjet printhead of claim 17, wherein the second nozzle orifice is positioned at an angle relative to the front surface of the nozzle plate such that the first flow path and the second flow path intersect at the predetermined location.

19. The continuous inkjet printhead of claim 12, the printhead including a nozzle plate having a front surface, wherein the second nozzle orifice is positioned at a substantially perpendicular angle relative to the front surface of the nozzle plate.

20. The continuous inkjet printhead of claim 19, further comprising a raised structure positioned on the front surface of the nozzle plate adjacent to the second nozzle orifice.

21. The continuous inkjet printhead of claim 12, the printhead including a nozzle plate having a front surface, wherein the first nozzle orifice is positioned at a substantially perpendicular angle relative to the front surface of the nozzle plate.

22. The continuous inkjet printhead of claim 21, further comprising a raised structure positioned on the front surface of the nozzle plate adjacent to the first nozzle orifice.

23. The continuous inkjet printhead of claim 22, the printhead including a nozzle plate having a front surface, wherein the second nozzle orifice is positioned at a substantially perpendicular angle relative to the front surface of the nozzle plate.

24. The continuous inkjet printhead of claim 23, further comprising a raised structure positioned on the front surface of the nozzle plate adjacent to the second nozzle orifice.

* * * * *